US011285366B2

(12) United States Patent
Barnett

(10) Patent No.: US 11,285,366 B2
(45) Date of Patent: Mar. 29, 2022

(54) GOLFING GAME ASSEMBLY

(71) Applicant: Jennings Barnett, Lawrenceburg, KY (US)

(72) Inventor: Jennings Barnett, Lawrenceburg, KY (US)

( * ) Notice: Subject to any disclaimer, the term of this patent is extended or adjusted under 35 U.S.C. 154(b) by 24 days.

(21) Appl. No.: 16/891,480

(22) Filed: Jun. 3, 2020

(65) Prior Publication Data

US 2021/0379457 A1 Dec. 9, 2021

(51) Int. Cl.

*A63B 69/36* (2006.01)
*A63B 67/02* (2006.01)
*A63B 57/30* (2015.01)

(52) U.S. Cl.

CPC ..... *A63B 67/02* (2013.01); *A63B 57/357* (2015.10)

(58) Field of Classification Search

CPC ..... A63B 67/02; A63B 57/357
USPC ..... 473/150, 169–196, 159
See application file for complete search history.

(56) References Cited

U.S. PATENT DOCUMENTS 1,627,517 A * 5/1927 Littleford, Jr. ..... A63F 7/0628 273/317.2
2,849,238 A * 8/1958 Eldredge ..... A63B 67/02 473/180
3,797,833 A * 3/1974 Rokusek ..... A63B 57/40 473/180
3,884,469 A 5/1975 Morton
4,203,604 A 5/1980 La Grange
5,230,511 A * 7/1993 Gubany ..... A63B 57/40 473/196
5,575,483 A * 11/1996 Dineen ..... A63B 67/06 273/317.2
5,636,844 A * 6/1997 de Buys ..... A63B 67/02 273/317.2
5,766,086 A * 6/1998 Folsom ..... A63B 67/02 473/172
5,863,256 A 1/1999 MacLean
6,367,797 B1 4/2002 McKenna-Cress
6,884,178 B1 * 4/2005 Frost ..... A63B 57/40 473/150
7,914,387 B1 3/2011 Gugliotti
8,870,671 B1 * 10/2014 Foley ..... A63B 67/02 473/153
9,327,176 B1 * 5/2016 Goserud ..... A63B 67/02

* cited by examiner

*Primary Examiner* — Nini F Legesse

(57) ABSTRACT

A golfing game assembly for playing miniature golf games includes a plurality of cups, a plurality of poles, and a plurality of spheres. Each cup is truncated frustrum shaped so that a base of the cup can be positioned on a surface with the cup being stabilized in an upright configuration. Each pole is selectively couplable to a respective cup so that the pole extends substantially vertically from the respective cup. The pole has a flag engaged thereto distal from the respective cup. The spheres are hollow, and each sphere has a plurality of orifices positioned therein. A respective sphere can be positioned on the surface distal from a respective cup. A user then is positioned to strike the sphere with a golf club in an attempt to propel the sphere into a respective cup.

12 Claims, 7 Drawing Sheets

GOLFING GAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to game assemblies and more particularly pertains to a new game assembly for playing miniature golf games.

(2) Description of Related Art Including Information Disclosed Under 37 CFR 1.97 and 1.98

The prior art relates to game assemblies. Prior art game assemblies for playing golfing games may comprise combinations of different ball choices, golf club choices, and hole placement choices.

BRIEF SUMMARY OF THE INVENTION

An embodiment of the disclosure meets the needs presented above by generally comprising a plurality of cups, a plurality of poles, and a plurality of spheres. Each cup is truncated frustrum shaped so that a base of the cup is configured to be positioned on a surface with the cup being stabilized in an upright configuration. Each pole is selectively couplable to a respective cup so that the pole extends substantially vertically from the respective cup. The pole has a flag engaged thereto distal from the respective cup. The spheres are hollow and each sphere has a plurality of orifices positioned therein. A respective sphere is configured to be positioned on the surface distal from a respective cup. A user then is positioned to strike the sphere with a golf club in an attempt to propel the sphere into a respective cup.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
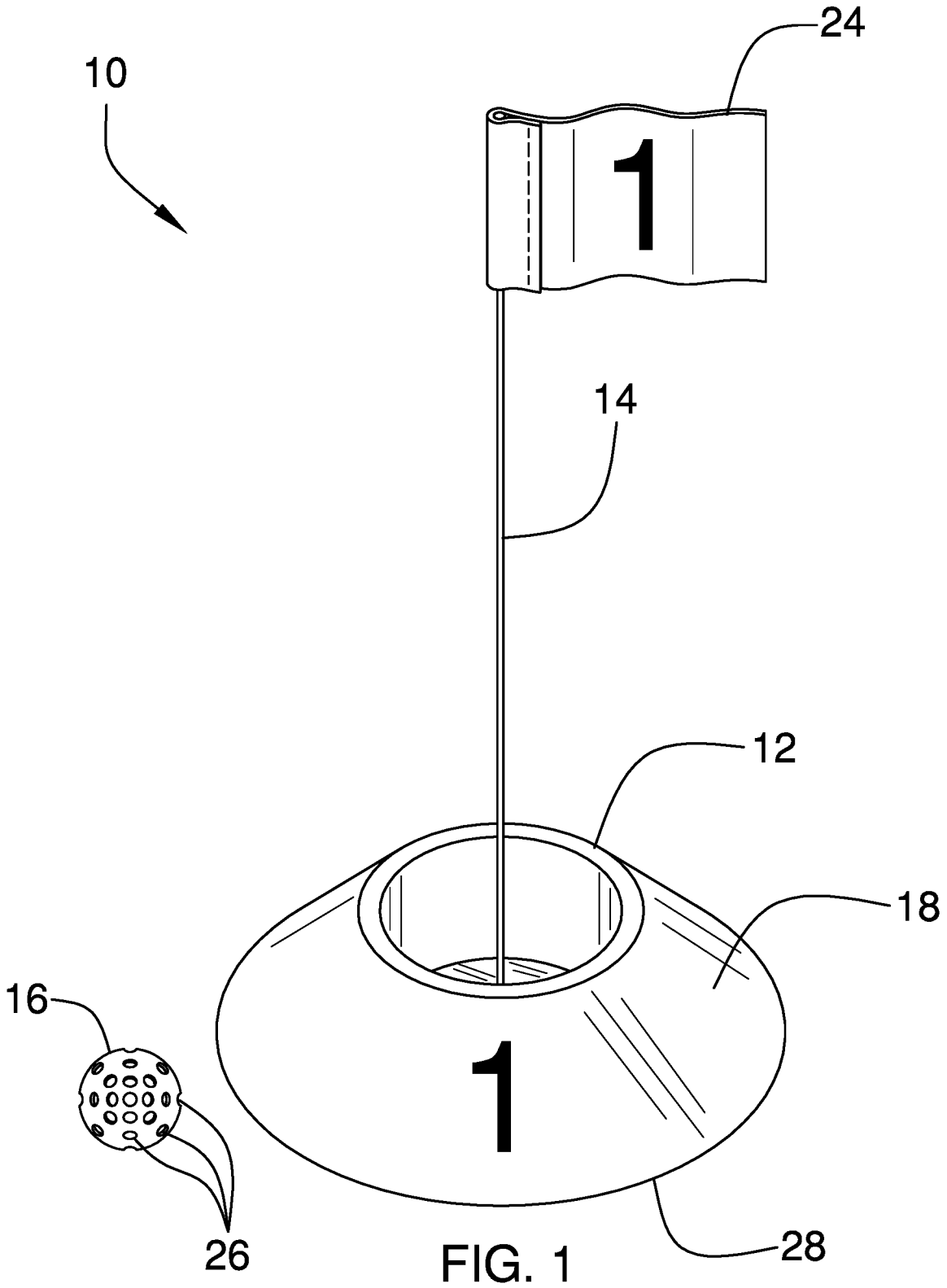
FIG. 1 is a front isometric perspective view of a golfing game assembly according to an embodiment of the disclosure.
Figure 2:
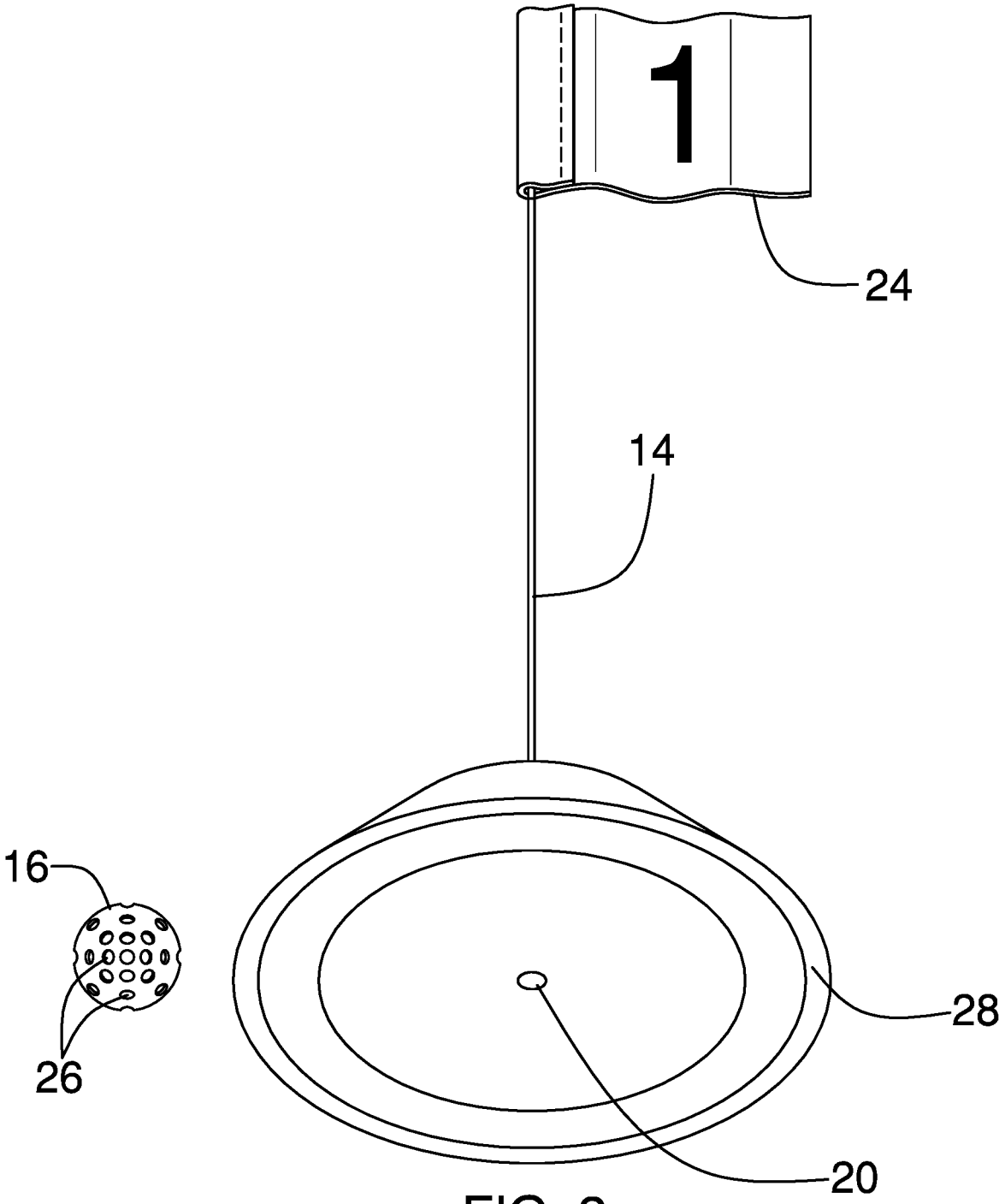
FIG. 2 is a bottom isometric perspective view of an embodiment of the disclosure.

With reference now to the drawings, and in particular to FIGS. 1 through 8 thereof, a new game assembly embodying the principles and concepts of an embodiment of the disclosure and generally designated by the reference numeral 10 will be described.

As best illustrated in FIGS. 1 through 8, the golfing game assembly 10 generally comprises a plurality of cups 12, a plurality of poles 14, and a plurality of spheres 16. Each cup 12 is truncated frustrum shaped so that a base 28 of the cup 12 is configured to be positioned on a surface with the cup 12 being stabilized in an upright configuration. Each cup 12 may truncated conically frustrum shaped, as shown in FIG. 1. The present invention anticipates other truncated frustrum shapes, such as, but not limited to, truncated square pyramidal shaped and the like.

Figure 3:
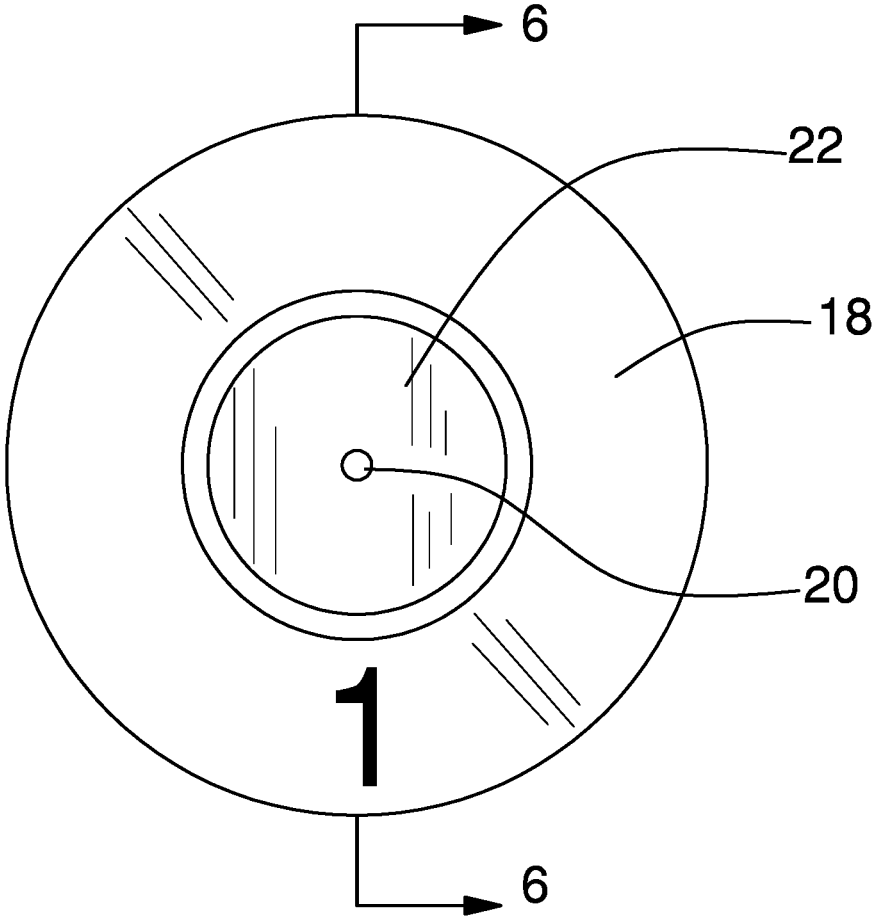
FIG. 3 is a top view of an embodiment of the disclosure.
Figure 4:
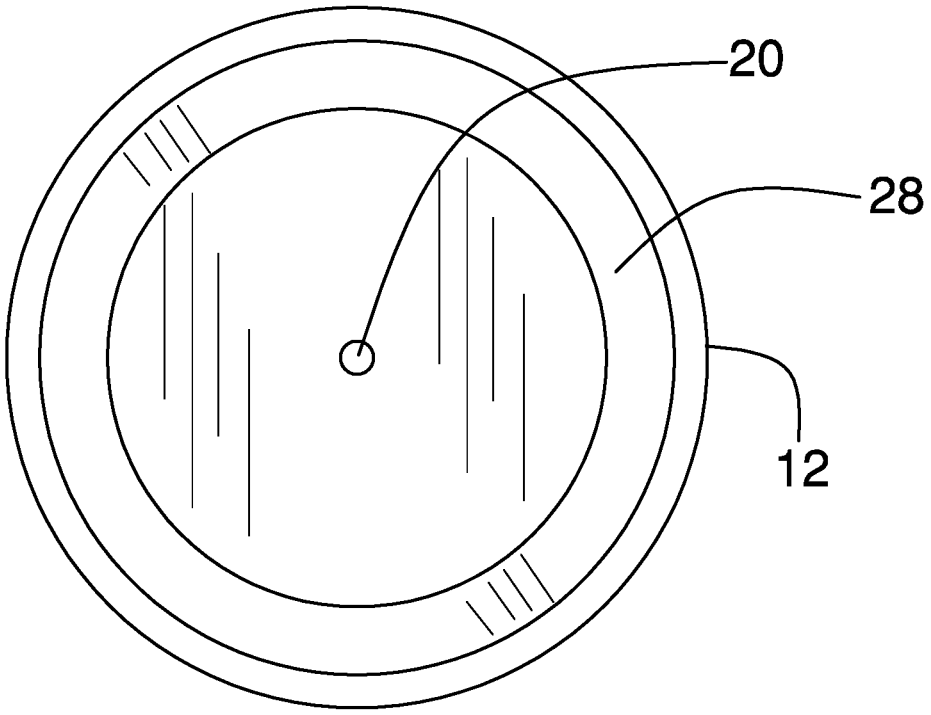
FIG. 4 is a bottom view of an embodiment of the disclosure.
Figure 5:
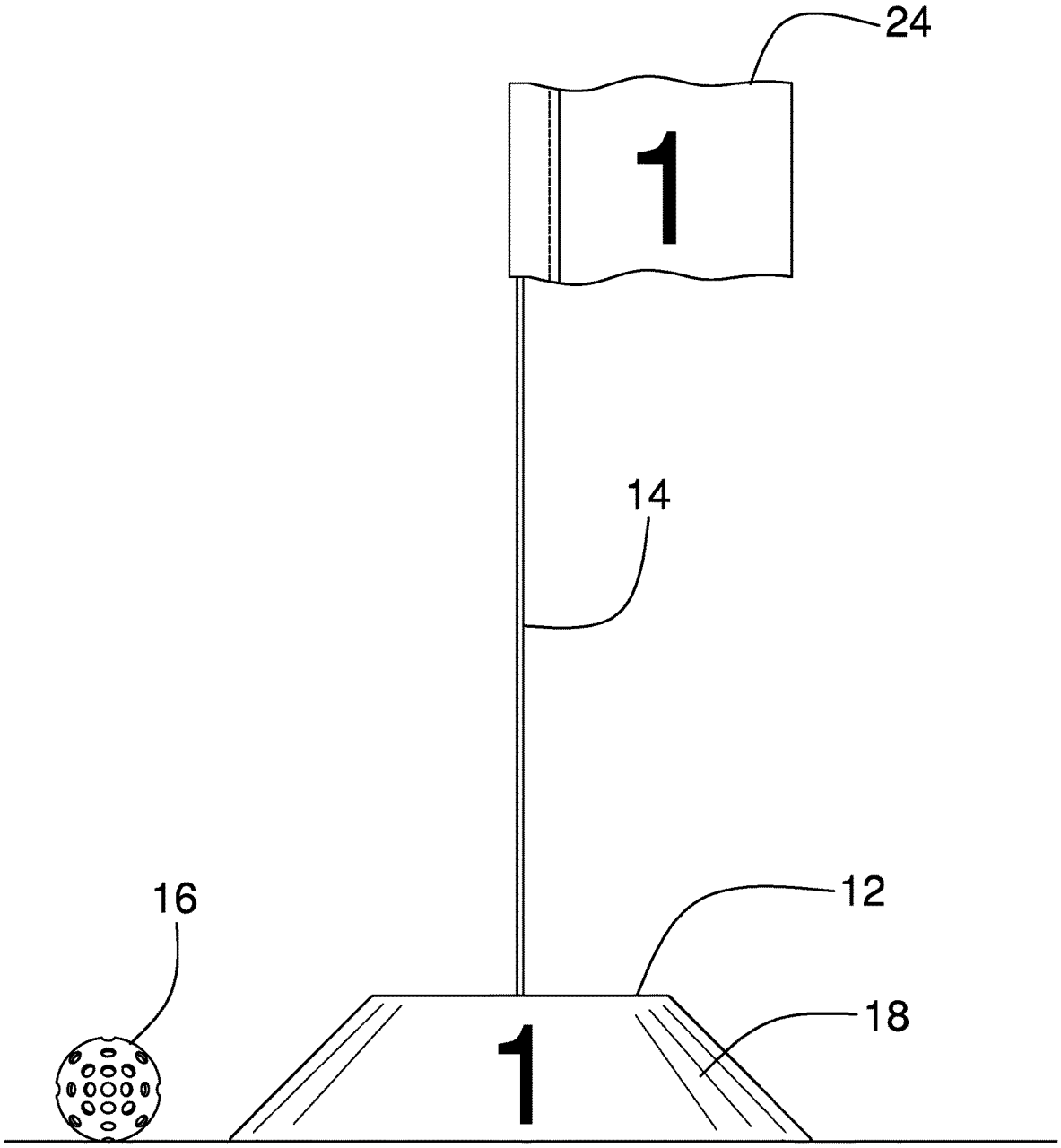
FIG. 5 is a front view of an embodiment of the disclosure.
Figure 6:
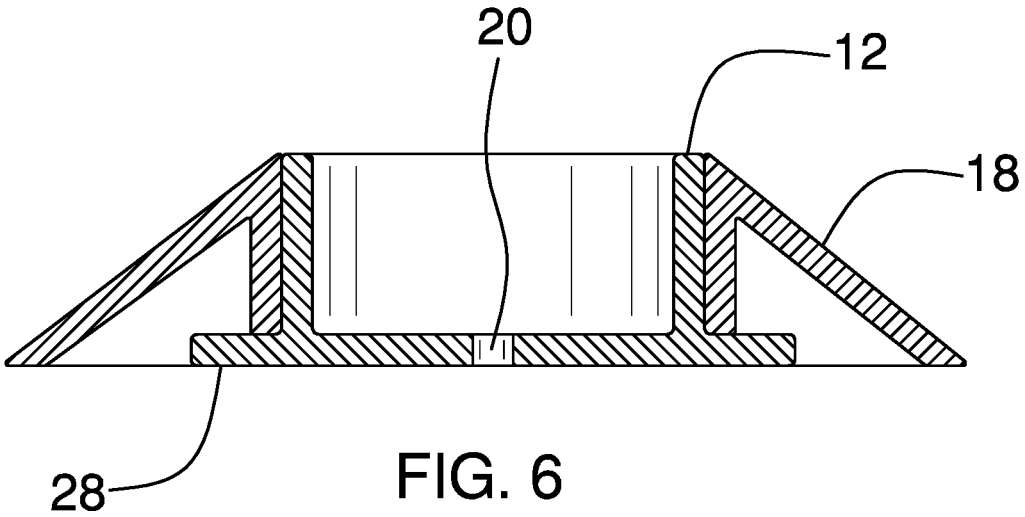
FIG. 6 is a cross-sectional view of an embodiment of the disclosure.
Figure 7:
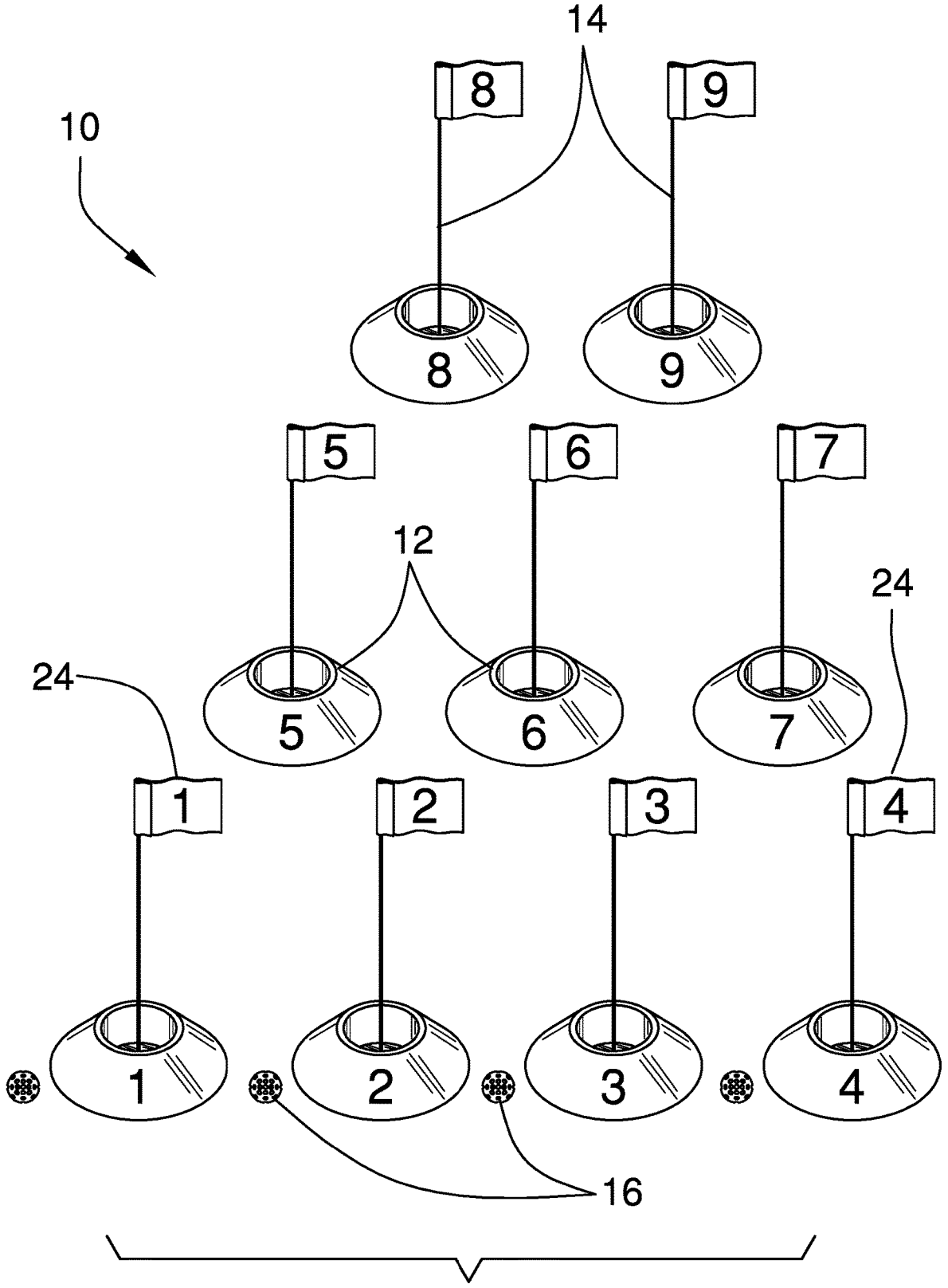
FIG. 7 is an assembly view of an embodiment of the disclosure.
Figure 8:
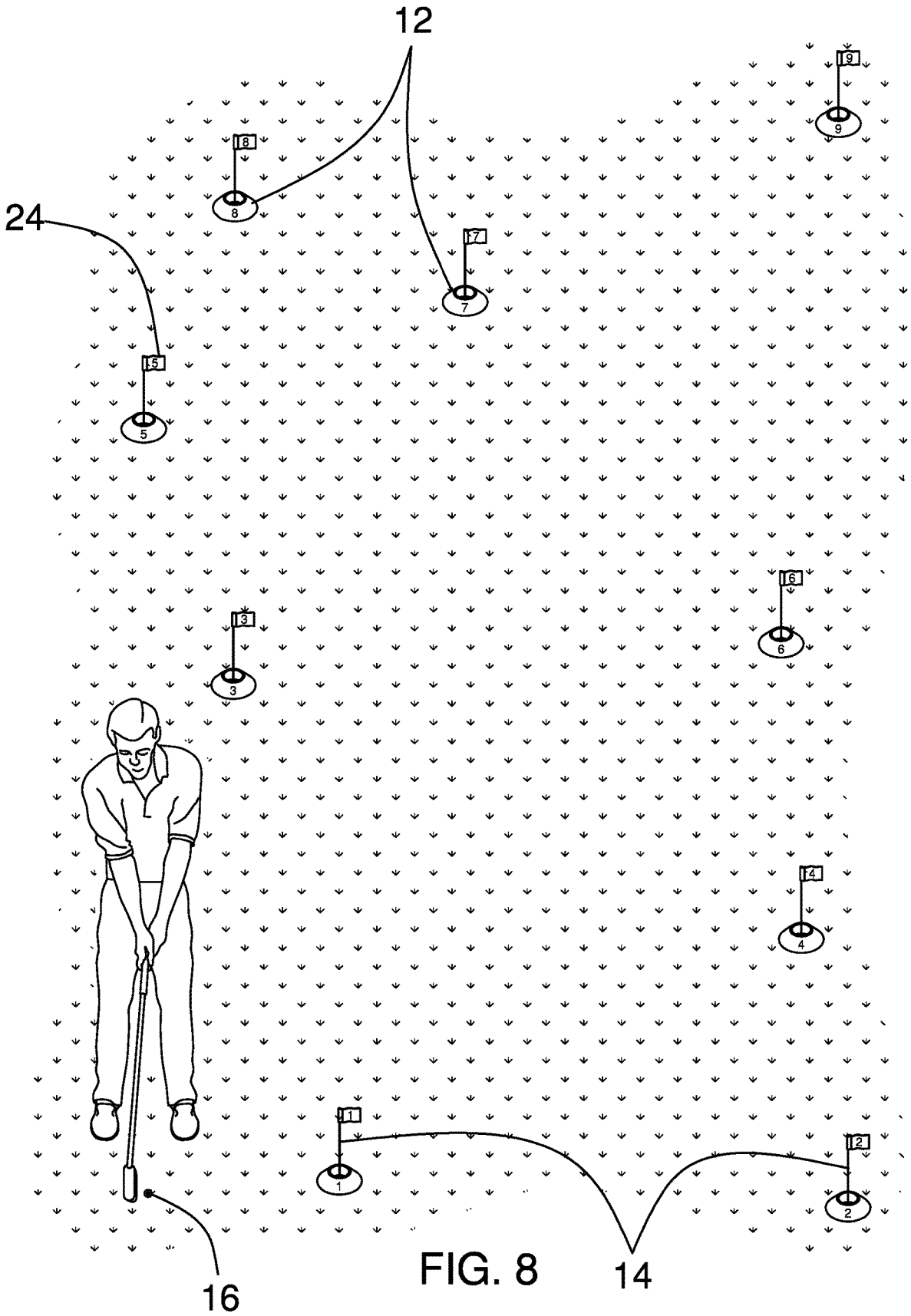
FIG. 8 is an in-use view of an embodiment of the disclosure.

Each cup 12 is numbered on a sidewall 18 thereof so that the plurality of cups 12 is sequentially numbered, as shown in FIG. 7. Each cup 12 has a hole 20 extending axially through a bottom 22 thereof, as shown in FIGS. 3 and 4. The plurality of cups 12 comprises from three to thirty six cups 12. The plurality of cups 12 may comprise from nine to eighteen cups 12. The plurality of cups 12 may comprise nine cups 12, as shown in FIGS. 7 and 8. Each cup 12 may have a respective color scheme so that the plurality of cups 12 comprises cups 12 having a variety of color schemes.

Each pole 14 is selectively couplable to a respective cup 12 so that the pole 14 extends substantially vertically from the respective cup 12. The pole 14 has a flag 24 engaged thereto distal from the respective cup 12. The pole 14 is selectively insertable into the hole 20 to engage the pole 14 to a respective cup 12. The flag 24 is numbered complementarily to the respective cup 12. The flag 24 may have a color scheme that is complementary to that of the respective cup 12.

The spheres 16 are hollow and each sphere 16 has a plurality of orifices 26 positioned therein. A respective sphere 16 is configured to be positioned on the surface distal from a respective cup 12. A user then is positioned to strike the sphere 16 with a golf club, such as a putter, in an attempt to propel the sphere 16 into a respective cup 12.

The assembly 10 also may comprise an instruction (not shown) for one or more users to play a golfing game utilizing the plurality of cups 12, the plurality of flags 24, the plurality of spheres 16, and golf clubs provided by the one or more users.

The assembly 10 also may comprise a scorecard (not shown) for tracking a score of a user playing a golfing game utilizing the plurality of cups 12, the plurality of flags 24, the plurality of spheres 16, and a golf club.

In use, the poles 14 with attached flags 24 are affixed to the cups 12 and the cups 12 are positioned on the surface. The assembly 10 may be used indoors and outdoors, with positioning, hazards, and the other parameters being determined by the user. As such, the assembly 10 is highly customizable. The user positions the sphere 16 on the surface and strikes the sphere 16 in an attempt to propel the sphere 16 into a respective cup 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A golfing game assembly comprising:

a plurality of cups, each said cup having a base comprising a flange and an annular wall extending up from said flange, a bottom of said flange being planar wherein said base of the cup is configured for positioning on a surface such that the cup is stabilized in an upright configuration, each said base having a sidewall comprising a central wall being complementary in shape to an exterior of said annular wall of said base and an angled surface extending outwardly and downwardly from a distal edge of said central wall wherein each said cup has a truncated conical frustrum shape;

a plurality of poles, each pole being selectively couplable to a respective cup such that the pole extends substantially vertically from the respective cup, the pole having a flag engaged thereto distal from the respective cup; and a plurality of spheres, the spheres being hollow, each sphere having a plurality of orifices positioned therein, wherein a respective sphere is configured for positioning on the surface distal from a respective cup, positioning a user for striking the sphere with a golf club in an attempt to propel the sphere into a respective cup.

2. The golfing game assembly of claim 1, wherein the plurality of cups comprises from three to thirty six cups.

3. The golfing game assembly of claim 2, wherein the plurality of cups comprises from nine to eighteen cups.

4. The golfing game assembly of claim 3, wherein the plurality of cups comprises nine cups.

5. The golfing game assembly of claim 1, wherein:

each cup has a hole extending axially through a bottom thereof; and the pole is selectively insertable into the hole for engaging the pole to a respective cup.

6. The golfing game assembly of claim 1, wherein each cup is numbered on said sidewall thereof such that the plurality of cups is sequentially numbered.

7. The golfing game assembly of claim 6, wherein the flag is numbered complementarily to the respective cup.

8. The golfing game assembly of claim 1, wherein each cup has a respective color scheme such that the plurality of cups comprises cups having a variety of color schemes.

9. The golfing game assembly of claim 8, wherein the flag has a color scheme complementary to the respective cup.

10. The golfing game assembly of claim 1, further including an instruction for one or more users to play a golfing game utilizing the plurality of cups, the plurality of flags, the plurality of spheres, and golf clubs provided by the one or more users.

11. The golfing game assembly of claim 10, further including a scorecard for tracking a score of a user playing a golfing game utilizing the plurality of cups, the plurality of flags, the plurality of spheres, and a golf club.

12. A golfing game assembly comprising:

a plurality of cups, each said cup having a base comprising a flange and an annular wall extending up from said flange, a bottom of said flange being planar wherein said base of the cup is configured for positioning on a surface such that the cup is stabilized in an upright configuration, each said base having a sidewall comprising a central wall being complementary in shape to an exterior of said annular wall of said base and an angled surface extending outwardly and downwardly from a distal edge of said central wall wherein each said cup has a truncated conical frustrum shape, each cup being numbered on said sidewall thereof such that the plurality of cups is sequentially numbered, each cup having a hole extending axially through a bottom thereof, the plurality of cups comprising from three to thirty six cups, each cup having a respective color scheme such that the plurality of cups comprises cups having a variety of color schemes;

a plurality of poles, each pole being selectively couplable to a respective cup such that the pole extends substantially vertically from the respective cup, the pole having a flag engaged thereto distal from the respective cup, the pole being selectively insertable into the hole for engaging the pole to a respective cup, the flag being numbered complementarily to the respective cup, the flag having a color scheme complementary to the respective cup;

a plurality of spheres, the spheres being hollow, each sphere having a plurality of orifices positioned therein, wherein a respective sphere is configured for positioning on the surface distal from a respective cup, positioning a user for striking the sphere with a golf club in an attempt to propel the sphere into a respective cup;

an instruction for one or more users to play a golfing game utilizing the plurality of cups, the plurality of flags, the plurality of spheres, and golf clubs provided by the one or more users; and a scorecard for tracking a score of a user playing a golfing game utilizing the plurality of cups, the plurality of flags, the plurality of spheres, and a golf club.

* * * * *